US012791251B2

(12) United States Patent
Kong et al.

(10) Patent No.: US 12,791,251 B2
(45) Date of Patent: Nov. 10, 2026

(54) METHOD FOR INCREASING PRODUCTION FLEXIBILITY OF AN AIR SEPARATION UNIT

(71) Applicant: L'Air Liquide, Societe Anonyme pour l'Etude et l'Exploitation des Procedes Georges Claude, Paris (FR)

(72) Inventors: Paul Kong, Houston, TX (US); Richard Pawulski, Houston, TX (US); John Somavarapu, Houston, TX (US); Stephanie Showalter, Houston, TX (US)

(73) Assignee: Air Liquide Large Industries U.S. LP, Houston, TX (US)

( * ) Notice: Subject to any disclaimer, the term of this patent is extended or adjusted under 35 U.S.C. 154(b) by 156 days.

(21) Appl. No.: 18/960,968

(22) Filed: Nov. 26, 2024

(65) Prior Publication Data

US 2026/0146790 A1 May 28, 2026

(51) Int. Cl.
*F25J 3/04* (2006.01)

(52) U.S. Cl.
CPC ..... *F25J 3/04412* (2013.01); *F25J 3/04024* (2013.01); *F25J 3/04781* (2013.01); *F25J 3/04848* (2013.01); *F25J 2215/42* (2013.01); *F25J 2215/50* (2013.01)

(58) Field of Classification Search
CPC .. F25J 2215/42; F25J 2215/50; F25J 2230/24; F25J 2230/40; F25J 2250/50; F25J 3/04024; F25J 3/04084; F25J 3/0409; F25J 3/04296; F25J 3/04412; F25J 3/04781; F25J 3/04812; F25J 3/04836; F25J 3/04848; F25J 3/04957
See application file for complete search history.

(56) References Cited

U.S. PATENT DOCUMENTS

| | | | | |
|---|---|---|---|---|
| 10,436,505 | B2 * | 10/2019 | Jiang | F25J 3/0271 |
| 10,443,930 | B2 * | 10/2019 | Jiang | F25J 3/0209 |
| 10,981,103 | B2 * | 4/2021 | Parsnick | F25J 3/04812 |
| 11,913,720 | B2 * | 2/2024 | Kaneda | F25J 3/04848 |
| 12,044,471 | B2 * | 7/2024 | Lochner | F25J 1/0202 |
| 12,247,007 | B2 * | 3/2025 | Prasetiyo | B01D 3/4294 |
| 2007/0221492 | A1 * | 9/2007 | Guillard | F25J 3/04951 203/49 |
| 2021/0063085 | A1 * | 3/2021 | Briglia | F25J 3/0409 |
| 2022/0196325 | A1 * | 6/2022 | Kong | F25J 3/04412 |
| 2024/0353174 | A1 * | 10/2024 | Turney | F25J 3/04812 |

* cited by examiner

*Primary Examiner* — Filip Zec
(74) *Attorney, Agent, or Firm* — Justin K. Murray

(57) ABSTRACT

An apparatus and method for the production of air gases by the cryogenic separation of air can include a cold box having a heat exchanger, and a system of columns; a flow meter, pressure monitoring device; a valve, and a controller. The cold box can be configured to receive a first and second purified and compressed air streams under conditions effective for cryogenically separating the air streams to form a plurality of air gas products. The controller is configured to adjust the production of liquid from the cold box by using the valve to adjust a flow rate of the second purified and compressed air stream to the cold box, such that closing the valve increases liquid production.

8 Claims, 2 Drawing Sheets

METHOD FOR INCREASING PRODUCTION FLEXIBILITY OF AN AIR SEPARATION UNIT

TECHNICAL FIELD OF THE INVENTION

The present invention generally relates to a method and apparatus for efficiently operating an air separation plant that is configured to produce variable amounts of liquid and gas products.

BACKGROUND OF THE INVENTION

Air separation plants separate atmospheric air into its primary constituents: nitrogen and oxygen, and occasionally argon, xenon and krypton. These gases are sometimes referred to as air gases.

A typical cryogenic air separation process can include the following steps: (1) filtering the air in order to remove large particulates that might damage the main air compressor; (2) compressing the pre-filtered air in the main air compressor and using interstage cooling to condense some of the water out of the compressed air; (3) passing the compressed air stream through a front-end-purification unit to remove residual water and carbon dioxide; (4) cooling the purified air in a heat exchanger by indirect heat exchange against process streams from the cryogenic distillation column; (5) expanding at least a portion of the cold air to provide refrigeration for the system; (6) introducing the cold air into the distillation column for rectification therein; (7) collecting nitrogen from the top of the column (typically as a gas) and collecting oxygen from the bottom of the column as a liquid.

In a typical ASU, it is common to use a process configuration utilizing an internal compression (pumping) cycle. As a non-limiting example, this includes pumping the liquid oxygen produced from the lower-pressure column from low pressure to a higher pressure and then vaporizing the pressurized oxygen within the heat exchanger, most commonly against a high pressure air stream coming from a booster air compressor ("BAC") or from the main air compressor ("MAC"). As used herein, a booster air compressor is a secondary air compressor that is located downstream of the purification unit that is used to boost a portion of the main air feed for purposes of efficiently vaporizing the product liquid oxygen stream.

Many industrial processes have fluctuating oxygen needs that can be met by cryogenic air separation plants designed to adjust their oxygen production rates. In these plants, liquid oxygen is stored when demand is low, while liquid nitrogen is stored when demand is high. During periods of high demand, the plant vaporizes the stored liquid oxygen to produce gaseous oxygen, while condensing the gaseous nitrogen it generates to provide liquid nitrogen.

However, this method suffers from inefficiencies and requires separate equipment for the storage of liquid products. Therefore, it would be advantageous to provide a method and apparatus that operated in a more efficient manner.

SUMMARY OF THE INVENTION

The present invention is directed to a method and apparatus that satisfies at least one of these needs.

In one embodiment, the invention can include a method for adjusting the liquid production of the air gases (e.g., nitrogen and oxygen) on demand, thereby reducing power consumption and/or increasing liquid production when desired.

In one embodiment, an apparatus for the production of air gases by the cryogenic separation of air is provided. In this embodiment, the apparatus may include: a main air compressor configured to compress air to a pressure suitable for the cryogenic rectification of air to produce a compressed humid air stream, the compressed humid air stream having a first pressure $P_o$; a front end purification system configured to purify the compressed humid air stream of water and carbon dioxide to produce a dry air stream having reduced amounts of water and carbon dioxide as compared to the compressed humid air stream; a booster compressor in fluid communication with the front end purification system, wherein the booster compressor is configured to compress a first portion of the dry air stream to form a boosted air stream, the boosted air stream having a first boosted pressure $P_{B1}$; a cold box comprising a main heat exchanger, a system of columns having a double column composed of a lower pressure column and a higher pressure column, a condenser disposed at a bottom portion of the lower pressure column, and a liquid oxygen pump, wherein the cold box is configured to receive the boosted air stream and a second portion of the dry air stream under conditions effective to separate air to form an air gas product, wherein the air gas product is selected from the group consisting of oxygen, nitrogen, and combinations thereof; a first conduit in fluid communication with the front end purification system and the cold box, wherein the conduit is configured to transfer a second portion of the dry air stream to the cold box; a valve disposed on the first conduit, the valve being configured to adjust a flow rate of the second portion of the dry air stream into the cold box; and a process controller configured to choose between a first mode of operation and a second mode of operation, wherein the first mode of operation results in increased gas production, wherein the second mode of operation results in increased liquid production.

In optional embodiments of the present invention:

- the process controller is further configured to access process conditions selected from the group consisting of spot pricing data for electricity, local liquid inventories, and combinations thereof; and/or
- during the second mode of operation, the process controller is configured to close the valve thereby reducing the flow of the second portion of the dry air stream to the cold box.

In another embodiment, a method for the production of air gases by the cryogenic separation of air is provided. In this embodiment, the method may include the steps of:

a) compressing air to a pressure suitable for the cryogenic rectification of air to produce a compressed humid air stream, the compressed humid air stream having a first pressure $P_o$;

b) purifying the compressed humid air stream of water and carbon dioxide within a front end purification system to produce a dry air stream having reduced amounts of water and carbon dioxide as compared to the compressed humid air stream;

c) compressing a first portion of the dry air stream in a booster compressor to form a boosted air stream, the boosted air stream having a first boosted pressure $P_{B1}$;

d) introducing a second portion of the dry air stream and the boosted air stream to a cold box under conditions effective to separate air to form an air gas product, wherein the air gas product is selected from the group consisting of oxygen, nitrogen, argon, and combinations thereof;

e) withdrawing the air gas product from the cold box, the air gas product having a first product pressure $P_{P1}$;

wherein the method further comprises an increased gas mode and an increased liquid mode, wherein during the increased liquid mode, the method further comprises the step of:

f) increasing liquid production from the cold box by reducing a flow rate of the second portion of the dry air stream introduced to the cold box.

In optional embodiments of the method:

the cold box comprises a main heat exchanger, a system of columns having a double column composed of a lower pressure column and a higher pressure column, a condenser disposed at a bottom portion of the lower pressure column, and a liquid oxygen pump;

the air gas product is oxygen; and/or the air gas product is nitrogen.

In yet another embodiment, a method for the production of air gases by the cryogenic separation of air is provided. In this embodiment, the method can include the steps of: sending a first air stream and a second air stream to a cold box under conditions effective for cryogenically separating the first and second air streams to form gaseous oxygen, liquid oxygen, gaseous nitrogen, and liquid nitrogen using a system of columns disposed within the cold box, wherein the first air stream is at a higher pressure than the second air stream when entering the cold box; and adjusting liquid production from the cold box by adjusting a flow rate of the second air stream, such that a lower flow rate of the second air stream results in increased liquid production from the cold box.

In one embodiment, a method for the production of air gases by the cryogenic separation of air with variable liquid production and power consumption can include the steps of:

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

While the invention will be described in connection with several embodiments, it will be understood that it is not intended to limit the invention to those embodiments. On the contrary, it is intended to cover all the alternatives, modifications and equivalence as may be included within the spirit and scope of the invention defined by the appended claims.

Due to product demand fluctuation, often times it is economically beneficial for an ASU to be able to exchange the production rates between liquid and gaseous products. In certain embodiments, the invention concerns a method and apparatus for varying production rate of a product in exchange of production rates of other products, more specially, high pressure gaseous oxygen product (HPGOX) in exchange of liquid products, such liquid oxygen (LOX), liquid nitrogen (LIN) and liquid argon (LAR) in an air separation unit (ASU). In certain embodiments, this can be achieved by shifting the capacities between main air compressor (MAC) and booster air compressor (BAC) by modulating a valve in a medium pressure feed air passage.

Figure 1:
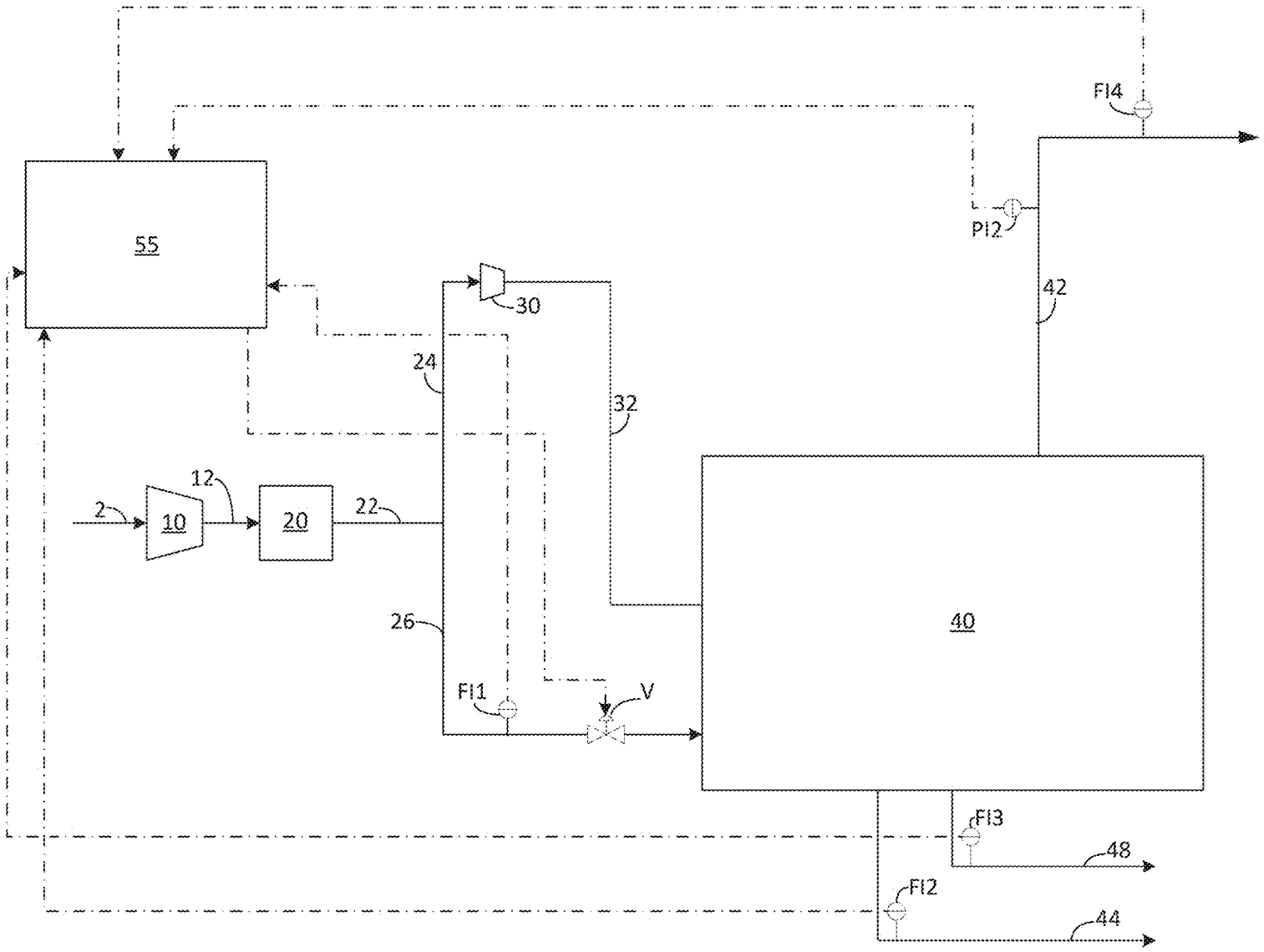
FIG. 1 provides an embodiment of the present invention.

Now turning to FIG. 1, which represents an embodiment configured to operate in a variable liquid mode. Air 2 is introduced into main air compressor 10 and compressed, preferably to a pressure of at least 55 psig to 75 psig (or around 5 psig higher than the pressure of the higher pressure column). The resulting compressed humid air stream 12 is then purified of water and $CO_2$ in front end purification system 20, thereby producing dry air stream 22. This dry air stream is then split into a first portion 24, and a second portion 26, with both portions being sent to the cold box. Within cold box 40, the air is cooled and cryogenically treated in order to separate the air into air gas product 42. First liquid air gas product 44 and/or second liquid air gas product 48 can also be removed from cold box 40 in certain modes of operation. The flow rate of first liquid air gas product 44 can be measured by flow indicator FI2, the flow rate of second liquid air gas product 48 can be measured by flow indicator FI3, and the flow rate of air gas product 42 can be measured by flow indicator FI4.

In one embodiment, the various pressure and flow indicators/sensors are configured to communicate (e.g., wirelessly or wired communication) with process controller 55, such that the various flow rates and pressures can be monitored by process controller 55, which is configured to adjust various settings throughout the process based on the measured flows and pressures.

Additionally, an embodiment of the present invention may also include booster air compressor 30. In this embodiment, first portion of dry air stream 24 is sent to booster air compressor 30 and further compressed to form boosted air stream 32 before being introduced to cold box 40. While the embodiment of FIG. 1 shows booster air compressor 30 as a single compressor, those of ordinary skill in the art will recognize that booster air compressor 30 can be more than one physical compressor. Additionally, booster air compressor 30 can also be a multi-stage compressor.

While the figures show direct lines of communication from the various pressure and flow indicators to the process controller 55, embodiments of the invention should not be so limited. Rather, those of ordinary skill in the art will recognize that embodiments of the invention may include instances in which certain indicators communicate directly with a related pressure controller.

When liquid demand (LIN, LOX, and/or LAR) increases, valve a can be adjusted in order to reduce the flow of second portion of dry air 26 sent to the cold box 40. As will be explained later, by adjusting this valve A to reduce flow of second portion of dry air 26, liquid production 44, 48 can be increased. This can be confirmed during operation using flow indicators FI2 and FI3.

Figure 2:
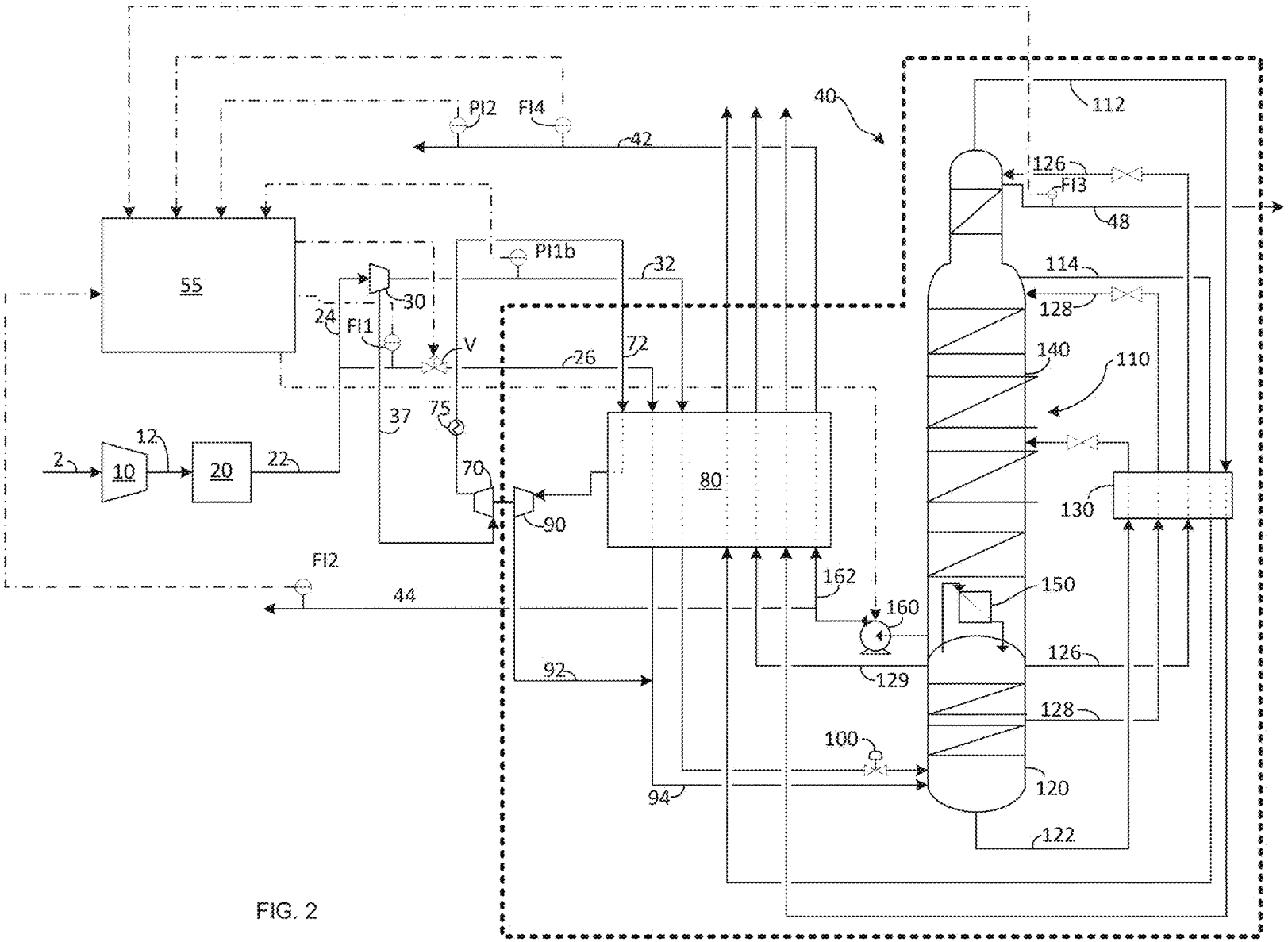
FIG. 2 provides another embodiment of the present invention providing additional detail for the cold box.

FIG. 2 provides a more detailed view of cold box 40. In this embodiment, cold box 40 also includes heat exchanger 80, turbine 90, valve 100, double column 110, higher pressure column 120, auxiliary heat exchanger 130, lower pressure column 140, condenser/reboiler 150, and liquid oxygen pump 160. Turbine 90 can be attached to booster 70 via a common shaft. Just like in FIG. 1, air 2 is introduced into main air compressor 10 and compressed, preferably to a pressure of at least 55 psig to 75 psig (or around 5 psig higher than the pressure of the MP column). The resulting compressed humid air stream 12 is then purified of water and $CO_2$ in front end purification system 20, thereby producing dry air stream 22. A first portion of dry air stream 24 is sent to booster air compressor 30, with the remaining portion of dry air stream 26 entering cold box 40, wherein it is fully cooled in heat exchanger 80 before being introduced via line 94 to higher pressure column 120 for separation therein. Following pressurization in booster air compressor 30, boosted air stream 32 is preferably fully cooled in heat exchanger 80 and then expanded across valve 100, before being introduced into a bottom portion of higher pressure column 120 for separation therein.

Partially boosted air stream 37 is preferably removed from an inner stage of booster air compressor 30 before being further compressed in secondary booster 70 and then cooled in after cooler 75 to form second boosted stream 72. Second boosted stream 72 undergoes partial cooling in heat exchanger 80, wherein it is withdrawn from an intermediate section of heat exchanger 80 and then expanded in turbine 90 thereby forming expanded air stream 92, which can then be combined with second portion of dry air stream 26 before introduction to higher pressure column 120.

Higher pressure column 120 is configured to allow for rectification of air within, thereby producing an oxygen-rich liquid 122 at the bottom and a nitrogen-rich gaseous stream 126 at the top. Oxygen-rich liquid 122 is withdrawn from the bottom of higher pressure column 120 before exchanging heat with low pressure waste nitrogen 114 and low pressure nitrogen product 112 in auxiliary heat exchanger 130, and then expanded across a valve and introduced into lower pressure column 140.

As is well known in the art, higher pressure column 120 and lower pressure column 140 are part of double column 110, and the two columns are thermally coupled via condenser/reboiler 150, which condenses rising nitrogen rich gas from higher pressure column 120 and vaporizes liquid oxygen that has collected at the bottom of lower pressure column 140. In the embodiment shown, two nitrogen-rich gas streams 126, 128 are withdrawn from higher pressure column 120, exchange heat with low pressure nitrogen product 112 and low pressure waste nitrogen 114, subsequently expanded across their respective valves, and then introduced into lower pressure column 140. Medium pressure nitrogen product 129 can also be withdrawn from higher pressure column 120 and then warmed in heat exchanger 80.

Liquid oxygen collects at the bottom of lower pressure column 140 and is withdrawn and pressurized to an appropriate pressure by liquid oxygen pump 160 to form liquid oxygen 162. Liquid oxygen 162 is then vaporized within heat exchanger 80 to form air gas product 42. The pressure and flow rate of air gas product 42 can be measured via second pressure sensor PI2 and FI1, respectively. Liquid oxygen product 44 from liquid oxygen pump 160 is delivered to the storage (not shown). Liquid nitrogen product 48 from top of lower pressure column 140 is delivered to the storage (not shown).

As with FIG. 1, when liquid demand (LIN, LOX, and/or LAR) increases, valve A can be adjusted in order to reduce the flow of second portion of dry air 26 sent to the cold box 40. By adjusting this valve A to reduce flow of second portion of dry air 26, the BAC 30 suction pressure increases, thereby increasing the available capacity of the BAC either in term of flow rate or discharge pressure, which in turn enables an increased flow and/or pressure across turbine 90. This ultimately results in increased liquid production due to increased refrigeration capacity (i.e., lower resulting temperature and increased flow rate of stream 92). At the same time, the available capacity of the MAC 10 will decrease due to the increase in back pressure, which causes a separation capacity (i.e., HPGOX production 42) to decrease.

On the other hand, when HPGOX demand 42 is high and liquid demand 44 is low, Valve A can be adjusted to a more open position. This decreases MAC discharge pressure, therefore, increases the available capacity of MAC 10, which in turn, enable to increase feed air 12, consequently, HPGOX production 42. Meanwhile, the available capacity of BAC 30 will decrease due to decrease in suction pressure, which in turn, reduces flow and/or pressure through turbine 90, and ultimately, liquid production of LOX 44.

The method is particularly useful for the existing facilities when MAC and/or MAC becomes the capacity bottleneck and modifications are not desirable.

Although this disclosure discloses the embodiments with respect to GOX product as an example, the concept can easily be applied to any other product (for example, high pressure gaseous nitrogen) that is produced by internal compression process In another embodiment, process controller 55 can be configured to access spot pricing data (or the user can input data into the controller), such that process controller 55 can be configured to optimize/adjust the amount of increased LIN and/or LOX based upon the current spot pricing data. Similarly, process controller 55 can also be configured to keep track of local inventories of LIN and/or LOX, and make adjustments to the production of LIN and/or LOX based on this additional data.

In another embodiment, process controller 55 can determine whether to operate in power savings mode or additional liquid production mode based upon certain conditions. For example, if electricity is cheaper than normal, saving power might not be of great importance, and therefore, process controller 55 can make a determination to switch to liquid production mode. In a preferred embodiment, process controller 55 makes these decisions automatically based on input conditions. In another embodiment, process controller 55 can include a manual override.

The terms "nitrogen-rich" and "oxygen-rich" will be understood by those skilled in the art to be in reference to the composition of air. As such, nitrogen-rich encompasses a fluid having a nitrogen content greater than that of air. Similarly, oxygen-rich encompasses a fluid having an oxygen content greater than that of air.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

We claim:

1. An apparatus for the production of air gases by the cryogenic separation of air, the apparatus comprising:

a) a main air compressor configured to compress air to a pressure suitable for the cryogenic rectification of air to produce a compressed humid air stream, the compressed humid air stream having a first pressure $P_o$;

b) a front end purification system configured to purify the compressed humid air stream of water and carbon dioxide to produce a dry air stream having reduced amounts of water and carbon dioxide as compared to the compressed humid air stream;

c) a booster compressor in fluid communication with the front end purification system, wherein the booster compressor is configured to compress a first portion of the dry air stream to form a boosted air stream, the boosted air stream having a first boosted pressure $P_{B1}$;

d) a cold box comprising a main heat exchanger, a system of columns having a double column composed of a lower pressure column and a higher pressure column, a condenser disposed at a bottom portion of the lower pressure column, and a liquid oxygen pump, wherein the cold box is configured to receive the boosted air stream and a second portion of the dry air stream under conditions effective to separate air to form an air gas product, wherein the air gas product is selected from the group consisting of oxygen, nitrogen, and combinations thereof;

e) a first conduit in fluid communication with the front end purification system and the cold box, wherein the conduit is configured to transfer a second portion of the dry air stream to the cold box;

f) a valve disposed on the first conduit, the valve being configured to adjust a flow rate of the second portion of the dry air stream into the cold box; and g) a process controller configured to choose between a first mode of operation and a second mode of operation, wherein the first mode of operation results in increased gas production, wherein the second mode of operation results in increased liquid production.

2. The apparatus as claimed in claim 1, wherein the process controller is further configured to access process conditions selected from the group consisting of spot pricing data for electricity, local liquid inventories, and combinations thereof.

3. The apparatus as claimed in claim 1, wherein during the second mode of operation, the process controller is configured to close the valve thereby reducing the flow of the second portion of the dry air stream to the cold box.

4. A method for the production of air gases by the cryogenic separation of air, the method comprising the steps of:

a) compressing air to a pressure suitable for the cryogenic rectification of air to produce a compressed humid air stream, the compressed humid air stream having a first pressure $P_o$;

b) purifying the compressed humid air stream of water and carbon dioxide within a front end purification system to produce a dry air stream having reduced amounts of water and carbon dioxide as compared to the compressed humid air stream;

c) compressing a first portion of the dry air stream in a booster compressor to form a boosted air stream, the boosted air stream having a first boosted pressure $P_{B1}$;

d) introducing a second portion of the dry air stream and the boosted air stream to a cold box under conditions effective to separate air to form an air gas product, wherein the air gas product is selected from the group consisting of oxygen, nitrogen, argon, and combinations thereof;

e) withdrawing the air gas product from the cold box, the air gas product having a first product pressure $P_{P1}$;

wherein the method further comprises an increased gas mode and an increased liquid mode, wherein during the increased liquid mode, the method further comprises the step of:

f) increasing liquid production from the cold box by reducing a flow rate of the second portion of the dry air stream introduced to the cold box.

5. The method as claimed in claim 4, wherein the cold box comprises a main heat exchanger, a system of columns having a double column composed of a lower pressure column and a higher pressure column, a condenser disposed at a bottom portion of the lower pressure column, and a liquid oxygen pump.

6. The method as claimed in claim 5, wherein the air gas product is oxygen.

7. The method as claimed in claim 5, wherein the air gas product is nitrogen.

8. A method for the production of air gases by the cryogenic separation of air, the method comprises the steps of:

sending a first air stream and a second air stream to a cold box under conditions effective for cryogenically separating the first and second air streams to form gaseous oxygen, liquid oxygen, gaseous nitrogen, and liquid nitrogen using a system of columns disposed within the cold box, wherein the first air stream is at a higher pressure than the second air stream when entering the cold box; and adjusting liquid production from the cold box by adjusting a flow rate of the second air stream, such that a lower flow rate of the second air stream results in increased liquid production from the cold box.

* * * * *